United States Patent [19]

Joos, Jr. et al.

[11] Patent Number: 4,773,646

[45] Date of Patent: Sep. 27, 1988

[54] MOVING TARGET ASSEMBLY

[75] Inventors: Joseph Joos, Jr., Chicago; Barry Oursler, Elmwood Park; Gary L. Berge, Crystal Lake, all of Ill.

[73] Assignee: Williams Electronics Games, Inc., Chicago, Ill.

[21] Appl. No.: 7,522

[22] Filed: Jan. 28, 1987

[51] Int. Cl.[4] ..... A63D 3/02; A63B 71/00

[52] U.S. Cl. ..... 273/121 A; 273/127 R

[58] Field of Search ..... 273/121 R, 127 R, 127 D, 273/118 D, 121 A, 127 B, 124 A

[56] References Cited

U.S. PATENT DOCUMENTS

| | | | |
|---|---|---|---|
| 2,520,283 | 8/1950 | Koci | 273/121 A |
| 2,551,698 | 5/1951 | Pear et al. | 273/121 A |
| 2,830,819 | 4/1958 | Pearl | 273/121 A |
| 4,190,252 | 2/1980 | Kindig | 273/270 |
| 4,221,384 | 9/1980 | Krynski | 273/118 R |
| 4,243,222 | 1/1981 | Grabel et al. | 273/127 R |
| 4,257,604 | 3/1981 | Grabel et al. | 273/127 R |
| 4,353,553 | 10/1982 | Krynski | 273/121 R |
| 4,354,681 | 10/1982 | Garbark | 273/121 R |
| 4,437,664 | 3/1984 | Wiczer et al. | 273/121 A |

FOREIGN PATENT DOCUMENTS 100339 11/1964 Denmark .

*Primary Examiner*—Richard C. Pinkham
*Assistant Examiner*—Gary Jackson
*Attorney, Agent, or Firm*—Niro, Scavone, Haller, Niro & Rocky, Ltd.

[57] ABSTRACT

This invention relates to a play feature for a pinball game. The invention includes a plurality of targets mounted on a target carrier. The target carrier can be raised above the surface of the playfield where the targets can be hit by a ball or lowered below the playfield so that the ball will pass over the targets. Located behind this first set of targets on the playfield is a second set of targets. This second set of targets is either covered by a visor or exposed to be contacted by a ball. The visor is operatively connected to the target carrier such that downward movement of the target carrier results in upward movement of the visor. In this manner, the two target areas are alternately exposed to the player to vary the scoring opportunities.

14 Claims, 3 Drawing Sheets

MOVING TARGET ASSEMBLY

BACKGROUND OF THE INVENTION

This invention relates generally to pinball games and, more particularly, to play features for such games.

Pinball games, as is well known, consist, generally, of an inclined playfield and a plurality of targets and other play features arranged on the playfield. A player uses flippers to direct a rolling ball at desired targets thereby scoring points.

The players of pinball machines are selective as to the machines they choose to play and base their selections on the various types of play feature schemes offered. Therefore, the popularity of a manufacturer's line of pinball games resides in its ability to appeal to the players by offering new and different play features.

OBJECTS AND SUMMARY OF THE INVENTION

It is a general object of the invention to provide a new and improved pinball machine play feature.

A further object of this invention is to provide a novel play feature which presents alternative targets to a player thus adding to the interest of the game.

Still another object is to provide a play feature which is economical to manufacture in terms of both the cost of the component parts, and the ease and time of assembly.

Another object is to provide a play feature which is durable enough to withstand repetitive cycles of play over a sustained period of time.

Other objects of the invention, in addition to those set forth above, will become apparent to those skilled in the art from the following description.

The invention in summary includes a plurality of targets mounted on a target carrier movable perpendicularly relative to the playfield. The carrier is alternately raised above the surface of the playfield where a target carried thereby can be hit by a ball or lowered below the playfield so that the ball will pass over any target mounted on the carriers.

Located behind the target carrier on the playfield is a second set of targets. The second set of targets is either covered by a visor or exposed to be contacted by the ball. The visor is operatively connected to the target carrier by a linkage system such that downward movement of the target carrier results in upward movement of the visor. In this manner, the two target areas are alternately exposed to the player to vary his scoring opportunities.

DETAILED DESCRIPTION OF A PREFERRED EMBODIMENT

Figure 1:
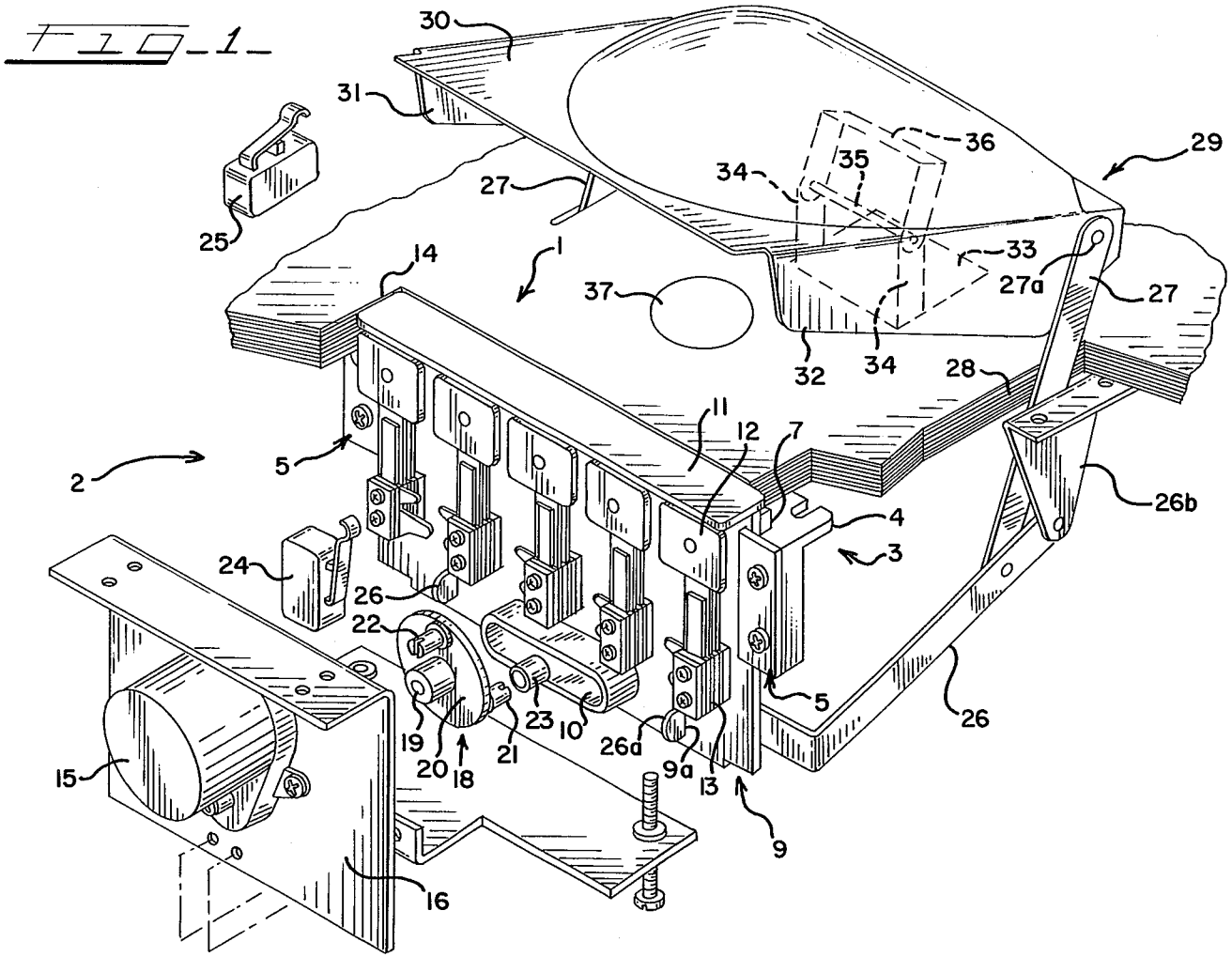
FIG. 1 shows a partially cut away perspective view of the play feature.

Referring more particularly to the drawings, FIG. 1 shows a portion of an inclined playfield 1 of a pinball machine, the rest of which is not shown, containing the play feature 2 of the present invention.

The device consists of a target guide 3 mounted to the underside of playfield 1. The target guide consists of a back plate 4 extending downward from and perpendicular to the playfield. Extending perpendicularly from the front face of the back plate 4 are two flanges 5. The flanges 5 which may be integrally formed with the back plate, are located at either end, and extend downwardly below the playfield. A guide plate 6 is provided on each of the flanges 5 and extend toward each other to form guide channels 7 extending perpendicularly to the playfield. The guide plates may be formed integrally with the flanges or attached thereto by any suitable means such as screws 8.

Located within the channel 7 of the target guide 3 is a target carrier 9. The target carrier is dimensioned so that it slidably fits within the vertically extending channel 7 of the target guide 3. Provided to the top edge of the target carrier 9 is a cover plate 11 disposed parallel to the playfield. The target carrier 9 and cover plate 11 are, therefore, arranged to form, basically, an elongated inverted L-shape in side view.

Mounted on the front face of the carrier plate 9 are a plurality of targets 12. The targets can be of any of the well-known types of targets and each includes an electrical switch 13 activated when a ball strikes the target to register a score, to enable another target or to permit such other action as a game designer might wish. The number of targets can vary according to the plans of a designer and may be as little as one if desired.

Provided on the face of the target carrier 9 is an elongated cam slot or follower 10. The cam slot 10 may be formed integrally with the target carrier by molding a suitable plastic material.

Located in the playfield, directly above the guide 7 of the target guide 3, is an elongated aperture 14. The aperture 14 has the same shape as the cover plate 11 but has slightly larger dimensions. With this arrangement the target carrier 9 is either free to move vertically in the target guides 7 and to extend through the aperture 14 above the playfield or to be positioned below its upper surface.

Figure 3:
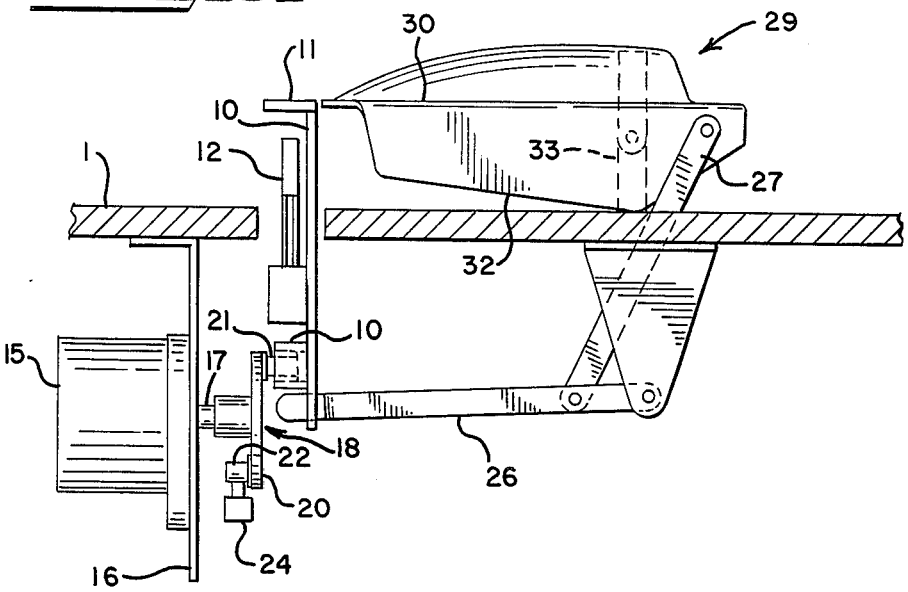
FIG. 3 shows a sectional side view of the play feature in the position corresponding to FIG. 2A.
Figure 4:
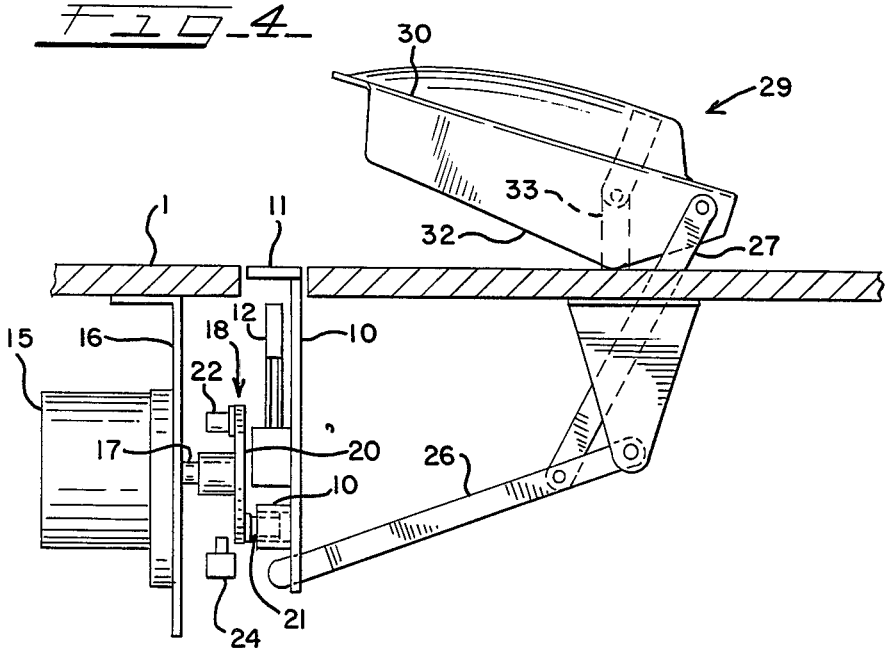
FIG. 4 shows a sectional side view of the play feature in the position corresponding to FIG. 2C.

When the target carrier is in its lowermost position, the cover plate 11 of the target carrier, shown in FIG. 4, is flush with the surface of the playfield. In this position the ball can freely roll over the cover plate. When the target carrier is in its uppermost position, shown in FIG. 3, the targets are at a height, above the playfield, where the ball is able to contact one of the targets 12 to activate its associated electrical switch 13.

The reciprocating movement of the target carrier is enabled by a motor 15. The motor 15 is attached to the underside of the playfield by a support or bracket 16 and is located directly in front of the target carrier. The motor 15 is provided with a rotary output shaft 17 fixedly secured to a camming disc 18 mounted on the output shaft of the motor by means of a boss 19 to rotate with the motor. The camming disc 18 is provided with two camming fingers 21 and 22. The camming fingers are arranged on opposite sides of the disc member and are spaced from one another around the disc member by 90°. Camming finger 21 extends from the disc toward the target carrier and carries a rotatable bearing sleeve 23, extending into the elongated, horizontally disposed cam slot 10 on the target carrier 9. Through this transmission arrangement the rotary motion of cam disc 18 is converted into the linear, reciprocating motion of the target carrier 9. One cycle of this motion is more specifically shown in FIGS. 2A–2D. As the cam disk rotates in the direction of the arrow A, the camming finger 21 slides in the cam slot 10 as it raises and lowers the carrier plate.

Figure 2B:
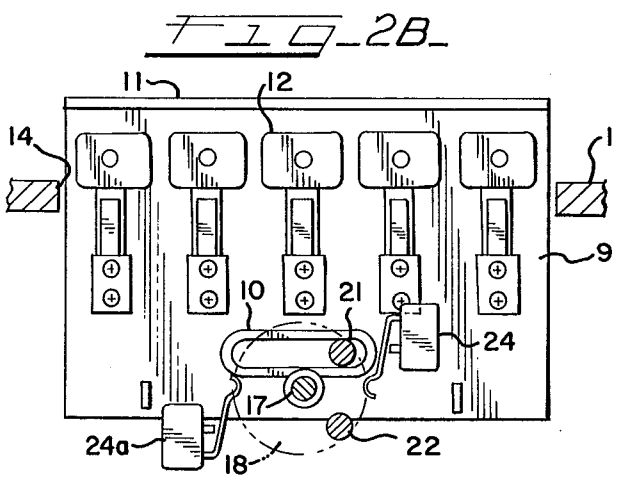
FIGS. 2A–2D show one cycle of the drive system as the target carrier is raised and lowered.
Figure 2D:
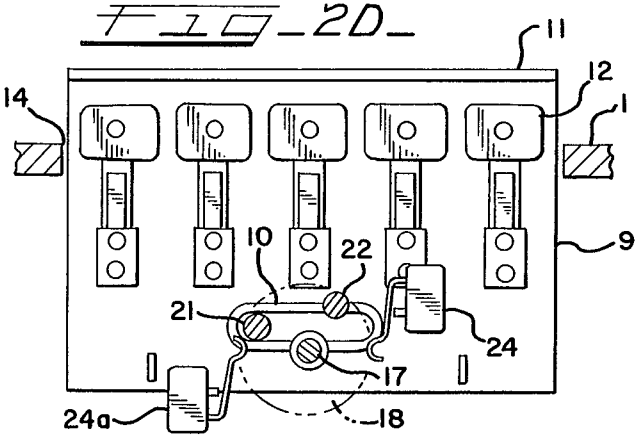
Figure 2A:
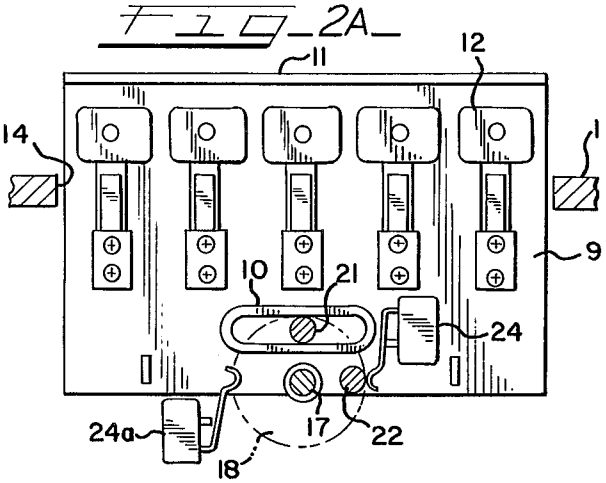
Figure 2C:
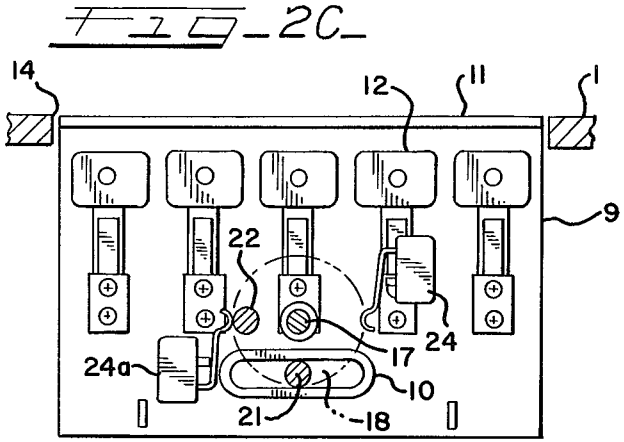

Specifically, upon the initiation of the cycle, the camming finger 21 will move to the right in the cam slot 10, as viewed in FIG. 2A. This occurs as the cam disc 18 rotates counterclockwise in the direction of the arrow, as shown in the drawing. As the camming finger 21 moves, it will lower the target carrier 9, due to the downward component of motion of the camming finger 21 resulting from the rotation of the cam disc 18. When the device assumes the position of FIG. 2B, the camming finger 21 will continue its downward movement and move to the left in the cam slot 10, as viewed in that figure, and continuously lower the target carrier 9 until it reaches the position of FIG. 2C. In FIG. 2C the cover plate 11 is flush with the upper surface of the playing field and balls may roll over it to contact other playfield features. The camming finger 21 will begin to move to the left in the cam slot 10 as the cam disc rotates further. From the position of FIG. 2D, the camming finger 21 will begin to move upwardly and as the camming finger raises the target carrier 9 to the position of FIG. 2A. At this point one cycle of the drive will have been completed.

On the back face of the cam disc 18, another camming finger 22 extends away from the target carrier and actuates the microswitches 24 and **24*a*. The microswitch 24 is attached to the motor support 16 and is located such that the camming finger 22 will contact and activate the microswitch once per revolution of the cam disc 18. When activated as shown in FIG. 2A, the motor 15 is shut off and will remain shut until it is turned on again in a manner to be described. Thus target carrier 9 will remain above the level of the playfield, exposing the targets 12 to be hit by a rolling ball. When the motor 15 is turned on and cam disc 18 rotates as described, that rotation continues until the camming finger 22 closes the switch 24*a* at the bottom of the travel of the target carrier, as shown in FIG. 2C. When the switch 24*a* is closed, the motor 15 is again stopped and the target carrier 9 is below the level of the playfield with the cover plate 11** flush with the upper surface of the playfield.

Located elsewhere on the playfield or closed by a target on the playfield is a switch 25, which when activated, will energize the motor to initiate the cycle shown in FIGS. 2A–2D. The switch 25 may be associated with another target on the playfield whereby contact of the ball with the target trips the switch to begin the cycle. In a microprocessor controlled game, a turn-on signal to the motor may be provided by a program instruction either randomly or on a timed basis.

A further feature of the game is the provision of a shield or visor which, when raised, exposes additional ball targets. The visor 29 is raised or lowered by connections to the movable target carrier 9 in the following manner.

Connected at one end to the target carrier 9 are a pair of lever arms only one of which, 26, is shown. The connection is made by passing a portion **26*a* of the lever arm through a slot 9*a* in the target carrier 9. The other ends of the lever arm are pivotally connected to mounting brackets 26*b* extending downwardly from the bottom surface of the playfield. Rigidly attached at one end to an intermediate point of the lever arm 26 is a linkage arm 27. The linkage arm 27 extends upwardly from the lever arm through an aperture 28 in the playfield and is pivotally connected at 27*a* to the downwardly depending sides 31 or 32 of the visor 29**.

The visor 29, in addition to having the downwardly depending sides 31 and 32, is provided with a top surface 30 extending between those downwardly depending sides. A bracket 33 is secured to the upper surface of the playfield and is provided with upstanding supports 34 carrying a pivot rod 35. A U-shaped bracket 36 is pivotally mounted to the pivot rod 35 and is secured by any suitable means to the surface of the shield 29.

By virtue of the linkage shown, when the target carrier 9 is below the surface of the playfield as shown in FIGS. 1 and 2C, the lever arm 26 is pulled downwardly about its pivot points on the bracket **26*b*. This causes the linkage arm 27 to move downwardly, pivotting the visor 29 about the pivot rod 35 to raise its front end to expose for possible ball contact any target which may be provided under the visor. Such a target could take any number of forms as, for instance, an opening 37** in the playfield to receive the ball and provide it with a scoring contact in its bottom, or a "bumper" kind of scoring device.

When the target carrier 9 is raised above the level of the playfield, as described above, the lever arm moves upwardly about its pivot point on the bracket **26*b*, causing the linkage arm 27 to move upwardly, pivotting the visor 29** in the opposite direction to lower it and thus hide the target provided beneath it.

The illustrated embodiment shows a mechanical system for controlling the operation of the visor 29 and target carrier 9. However, it is contemplated that the movement of these devices could be achieved by the use of other means, such as solenoids controlled by appropriate switching means.

Recapitulating, the arrangement is such that the target carrier may move upwardly to prevent a multiplicity of targets to the game player or move downwardly to provide a smooth surface permitting an interrupted in the path of the ball. At the same time, the surface 29 is either lifted or raised, exposing or hiding a target 27 provided beneath it.

Although the invention has been described in its preferred form with a certain degree of particularity, it is understood that the present disclosure has been made by way of example only. Numerous changes in the details and construction of the combination and arrangement of parts will be apparent without departing from the spirit and scope of the invention.

What is claimed is:

1. In a pinball game machine of the type having an inclined playfield which supports a rolling ball and one or more play features, the improved play feature comprising:

(a) first ball target means;

(b) second ball target means disposed behind and screened from play by the first ball target means;

(c) means for raising and lowering said first ball target means to put it in play and move it from play, respectively;

(d) means for shielding said second ball target means from all contact with the ball when said first ball target means is in play; and (e) means for operatively connecting said shielding means with said means for raising and lowering said first ball target means whereby when said first ball target means is removed from play said second ball target means is exposed to play and vice versa.

2. The play feature of claim 1, including a means for controlling the activation of said means for raising and lowering.

3. The play feature of claim 2, wherein the means for controlling comprises a first switch located on the playfield for starting said rotary drive means and a second switch operatively associated with said means for raising and lowering for stopping said rotary drive means.

4. The play feature of claims 1 or 2, including means associated with said first ball target means to register a score.

5. The play feature of claim 4, wherein said means for raising and lowering said first ball target means comprises:

a guide channel arranged perpendicularly to the playfield;

a carrier means for slidably supporting said first ball target means within said guide channel;

a rotary drive means; and a transmission means connecting the output of said rotary drive means to said carrier means converting said rotary drive means into the linear reciprocating movement of said carrier means.

6. The play feature of claim 5, wherein the transmission means comprises:

a horizontally extending slot on said carrier means;

a disk member fixedly attached to said rotary drive; and a camming finger attached to and extending out from said disk member, wherein said camming finger extends into said horizontally extending slot for operable engagement therewith.

7. The play feature of claims 1 or 2, including means associated with said second ball target means to register a score.

8. The play feature of claims 1 or 2, wherein said means for raising and lowering said first ball target means comprises:

a guide channel arranged perpendicularly to the playfield;

a carrier means for slidably supporting said first ball target means within said guide channel;

a rotary drive means; and a transmission means connecting the output of said rotary drive means to said carrier means converting said rotary drive means into the linear reciprocating movement of said carrier means.

9. The play feature of claim 5, wherein the transmission means comprises:

a horizontally extending slot on said carrier means;

a disk member fixedly attached to said rotary drive; and a camming finger attached to and extending out from said disk member, wherein said camming finger extends into said horizontally extending slot for operable engagement therewith.

10. The play feature of claim 8, wherein the means for connecting said means for raising and lowering said first ball target means with said shielding means comprises a mechanical linkage system.

11. The play feature of claim 8, wherein the means for controlling comprises a first switch located on the playfield for starting said rotary drive means and a second switch operatively associated with said means for raising and lowering for stopping said rotary drive means.

12. The play feature of claim 1, wherein the shielding means comprises a pivotable visor.

13. The play feature of claim 1, wherein the means for connecting said means for raising and lowering said first ball target means with said shielding means comprises a mechanical linkage system.

14. The play feature of claim 1, wherein said shielding means prevents the ball from contacting the second ball target means from the sides and back when said first ball target means is removed from play.

* * * * *